US005595253A

United States Patent [19]

Martin et al.

[11] Patent Number: 5,595,253

[45] Date of Patent: Jan. 21, 1997

[54] HYDRAULIC JAR WITH IMPROVED DETENT RING

[75] Inventors: Glenn J. Martin, Houma, La.; Chuan C. Teng, Houston, Tex.

[73] Assignee: Houston Engineers, Inc., Houston, Tex.

[21] Appl. No.: 506,105

[22] Filed: Jul. 24, 1995

[51] Int. Cl.[6] ..... E21B 4/14

[52] U.S. Cl. ..... 175/297; 166/178

[58] Field of Search ..... 166/178, 73; 175/297, 175/296, 300, 304, 321

[56] References Cited

U.S. PATENT DOCUMENTS 4,109,736 8/1978 Webb et al. .
4,361,195 11/1982 Evans ..... 175/297
4,456,081 6/1984 Newman .
4,582,148 4/1986 Walter ..... 175/297
5,086,853 2/1992 Evans ..... 175/297
5,174,393 12/1992 Roberts et al. .
5,425,430 6/1995 Roberts ..... 175/296
5,431,221 7/1995 Roberts et al. ..... 166/73
5,447,196 9/1995 Roberts ..... 166/178

*Primary Examiner*—Frank Tsay
*Attorney, Agent, or Firm*—Vaden, Eickenroht & Thompson, L.L.P.

[57] ABSTRACT

There is disclosed a double acting hydraulic jar of such construction as to permit it to be "short cocked" during either an up or down jar, and further in which flow past a detent in metered in such a way as to permit lesser flow therepast during an upward jar than during a downward jar, whereby the rate of movement of the detent ring through a restriction, and thus the "delay", may be essentially the same during both up and down jars.

6 Claims, 3 Drawing Sheets

FIG. 4
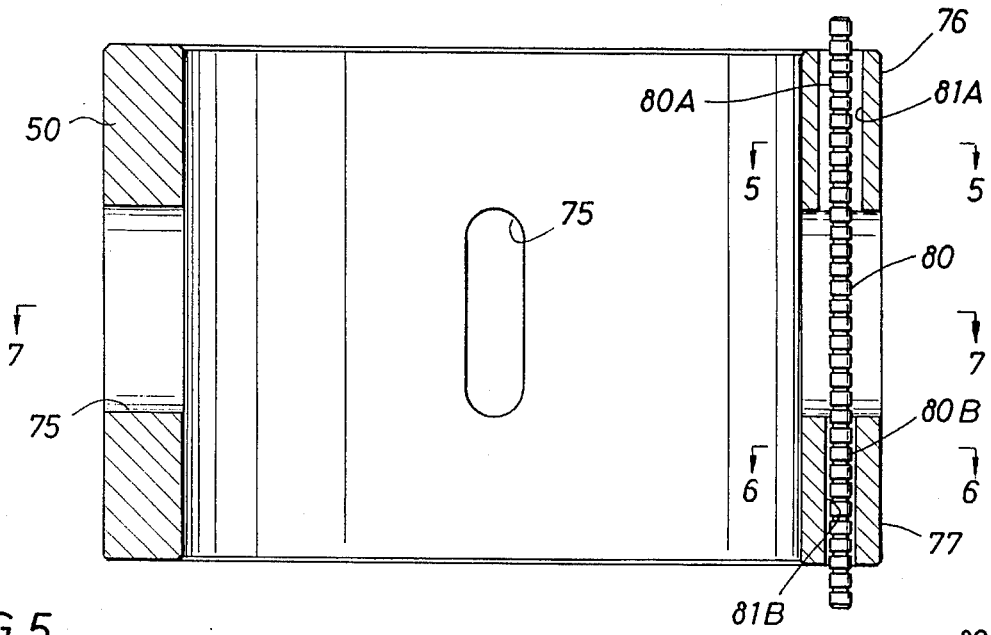
FIG. 5
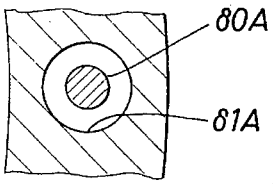
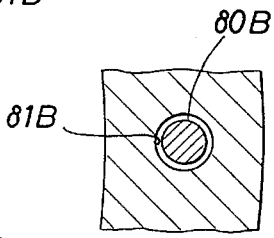
FIG. 6
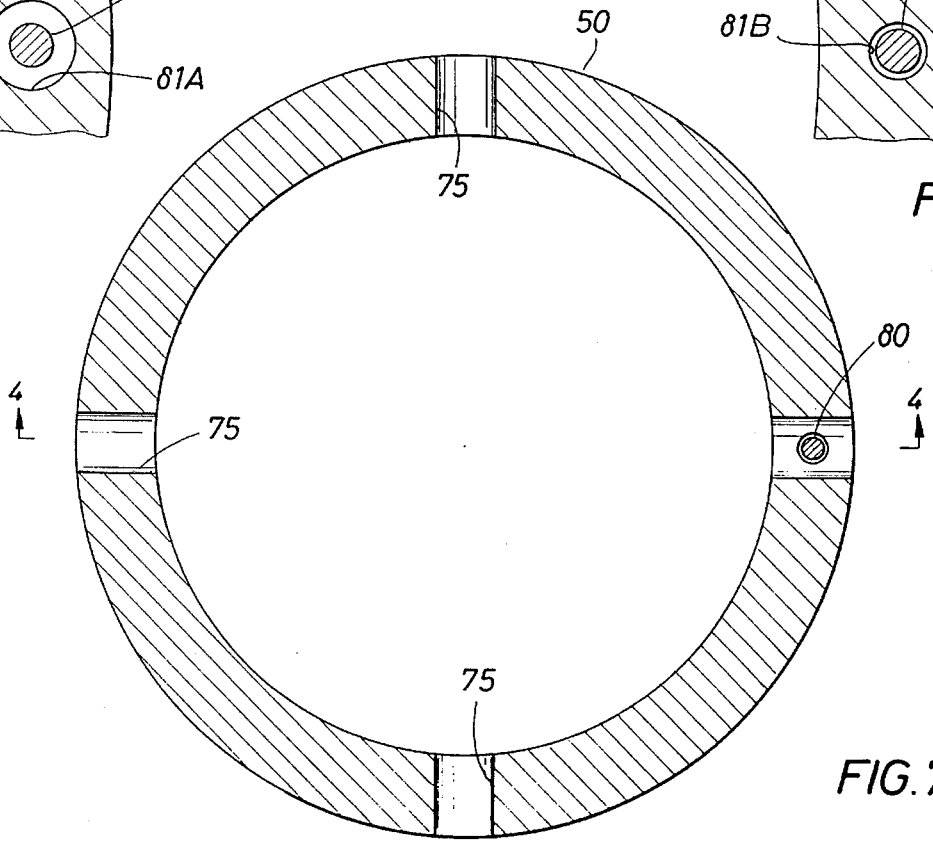
FIG. 7

HYDRAULIC JAR WITH IMPROVED DETENT RING

This invention relates generally to a tool for use in imparting a jar to an object stuck in a well bore, and, more particularly, to improvements in a so-called double acting hydraulic jar for imparting up and down jars to the object.

1. Field of the Invention

As well known in the art, a jar of this general type comprises a pair of telescopically arranged, tubular members, one for connection to the object and the other to a pipe string which may be raised and lowered within the well bore. More particularly, the members are circumferentially spaced apart to form an annular space between them with one member having a cylindrical surface which forms a restriction within the space and the other carrying detent means of such construction as to fit closely within the restriction so as to retard its movement therethrough and thus stretch the pipe string as it is raised, in the case of an up jar, or retard its movement therethrough and thus compress the pipe string as it is lowered, in the case of the down jar. The tubular members also have oppositely facing shoulders which are adapted to engage as the detent means moves out of the restriction so as to impart a jar to the object in the desired direction. The outer member is ported to connect the annulus with the well bore, and a piston is sealably slidable between the members within the space to separate the port from a detent chamber in which hydraulic fluid is contained. This, of course, equalizes the fluid pressure within the jar and well fluid in the annulus to facilitate raising and lowering of the jar within the well bore, as well as separating the hydraulic fluid from the well fluid to avoid contamination.

2. Description of the Prior Art

U.S. Pat. No. 4,109,736 shows several embodiments of a double acting hydraulic jar of this type, including one which has enjoyed considerable success in the industry. In this form of the jar, which is illustrated and described in connection with FIGS. 8 to 16, there are a pair of detent chambers each having a restriction formed on one member thereof and a pair of detent means each carried by the other member for movement through the restriction in one of the chambers. A balance chamber is disposed between and separated from each detent chamber by a piston ring sealably slidable between the members so that each detent means operates independently of and is unaffected by the other. More particularly, the detent means are so arranged with respect to one another and the restrictions that each may be "short cocked" in preparation for a subsequent jar.

Thus, with reference to the above mentioned figures of U.S. Pat. No. 4,109,736, assume that the tool has just delivered an upward jar following movement of the upper detent means out of the upper restriction. During this time, of course, the lower detent means has moved through the lower restriction without pressurizing the fluid in the lower hydraulic chamber due to the fact that its detent means is reversed with respect to the upper detent mechanism. If then another upward jar is to be delivered, the tool may be moved into a "short cocked" position by lowering the upper detent means in the restriction until the weight detector indicates that the lower detent means has begun to move into the lower restriction. Obviously, a reversal of this procedure permits the jar to be moved into a short cocked position following a down jar.

U.S. Pat. No. 4,456,081 discloses a double-acting, hydraulic jar in which detent means for imparting both up and down jars are contained within a single detent chamber having a single restriction through which the detent means are moved during an up or down jar. Moreover, the detent means are so constructed and arranged as to permit the jar to be "short cocked" preparatory to repeated up or down jars. That is, the detent means for retarding flow during an up jar is arranged beneath the detent means for retarding flow during a down jar so that following an up jar, it may be moved downwardly a short distance into the restriction before the detent means for retarding flow during a down jar enters the restriction. Conversely, following a down jar, the means for retarding flow during a down jar may be moved upwardly a short distance into the restriction ("short cocked") before the means for retarding flow during and up jar enters the restriction.

Although this theoretically permits the overall length of the jar to be shortened, at least as compared to the aforementioned jar shown in the above mentioned figures of U.S. Pat. No. 4,109,736, the detent means are of such construction as to be susceptible to considerable wear and malfunction. Thus, hydraulic fluid in the detent chamber must pass through spring biased check valves, as the detent means move through the restriction, and a portion of the tubular member on which the detent means are mounted forms seals with respect to the restriction as the adjacent detent means are moved therethrough.

U.S. Pat. No. 5,174,393 shows a double acting hydraulic jar of this type, which, like those of the aforementioned patents, is capable of "short-cocking", and further, like that of U.S. Pat. No. 4,456,081, is of such construction that the detent means is disposed in one chamber.

In accordance with good operating procedures, the available pull at the rig is greater than the available push, so that the time required to cause an up jar is less than the time required to cause a down jar. Ideally, however, the operator desires to maintain the same detent "delay" in both directions. One may compensate for this in a jar of the type shown in U.S. Pat. No. 4,109,736, wherein there are detent means in each of two chambers. Thus, for example, the viscosity of the oil in the chamber for the up detent means may be greater than that in the chamber for the up detent means.

However, a jar having only a single detent means in a single detent chamber, such as that of U.S. Pat. No. 5,174,393, does not afford these "timing" options. Hence, it is the object of this invention to provide such a jar in which the detent delay may be essentially the same whether during an up or a down jar, and, more particularly, to provide such a jar which involves, in its preferred embodiment, only relatively minor alterations to that of U.S. Pat. No. 5,174,393.

SUMMARY OF THE INVENTION

These and other objects are accomplished by a jar of the type shown and described in Pat. No. 5,174,393 and thus comprising first and second telescopically arranged, tubular members connectible, respectively, to the stuck object and a pipe string adapted to be raised and lowered within the well bore, and being circumferentially spaced apart and sealed with respect to one another along equal diameter portions to form an annular space therebetween, with the outer member having a port therein to connect one end of the space with the well bore, and a piston ring being sealably slidable within the space to separate the port from a detent chamber within the space which contains hydraulic fluid. Moreover, one of the tubular members has a cylindrical restriction within the chamber and the other tubular member has longitudinal grooves formed about its circumference intermediate longitudinally spaced upper and lower shoulders, and detent ring means is carried by the other member with one side closely surrounding the grooves and vertically reciprocable with respect to said other member between a first position in which its lower end is seated on the lower shoulder of the other member to prevent flow therepast, as a lower annular portion of its other side is pulled upwardly through the restriction, and a second position in which its upper end is seated on the upper shoulder of said other member to prevent flow therepast, as an upper annular portion of its other side is pushed downwardly through the restriction.

As in the prior jar, the detent ring means has metering means which permit limited flow therethrough as said annular portions move through said restriction and means connecting its one side with its other side intermediate said annular portions so that the annular portion last to move out of the restriction is relatively freely movable back into the restriction until the other annular portion enters the restriction. More particularly, the tubular members have means arranged to engage one another for imparting an up jar to the stuck object as the lower annular portion of the detent ring means is pulled upwardly out of the restriction and a down jar thereto as the upper annular portion of the detent ring means is pushed downwardly out of the restriction. However, in accordance with the present invention, the metering means is of such construction as to permit a lesser volume of limited flow therethrough, during an upward jar, then during a downward jar, whereby the rate of movement of the detent means through the restriction, and thus the "delay" may be essentially the same during both up and down jars.

More particularly, the metering means comprises upper and lower holes in the detent ring means extending between the connecting means and the annular spaces above and below the detent ring means, respectively, and means including upper and lower pin portions extending through the upper and lower holes, respectively, with the holes and pin portions being of said construction that the annular space between the upper hole and the upper pin portions is of greater than that between the lower hole and lower pin portion. As shown, the upper hole is of larger diameter than the lower hole, and the upper and lower pin portions are of essentially the same diameter.

In the preferred embodiment of the invention, the detent means comprises a single detent ring having passageway means therein connecting its inner with its outer side intermediate said annular portions, and the pin portions comprise a single pin having its upper end extending through the upper hole and its lower end extending through the lower hole. More particularly, the passageway means comprises a hole extending through the detent ring to connect its opposite sides, wherein, as above noted, the upper hole is of larger diameter than that of the lower hole, and the pin is of essentially constant diameter.

BRIEF DESCRIPTION OF THE DRAWINGS

In the drawings, wherein like characters are used to designate like parts:

FIG. 4 is a still further enlarged vertical section view of the detent ring, as seen along broken lines 4—4 of FIG. 7;

FIGS. 5 and 6 are further enlarged cross-sectional views of the upper and lower portion of the metering pins and the holes in the detent ring through which they extend, respectively, as seen along lines 5—5 and 6—6 of FIG. 4; and FIG. 7 is a cross sectional view of the detent ring, as seen along lines 7—7 of FIG. 4.

DESCRIPTION OF THE PREFERRED EMBODIMENT

Figure 1A:
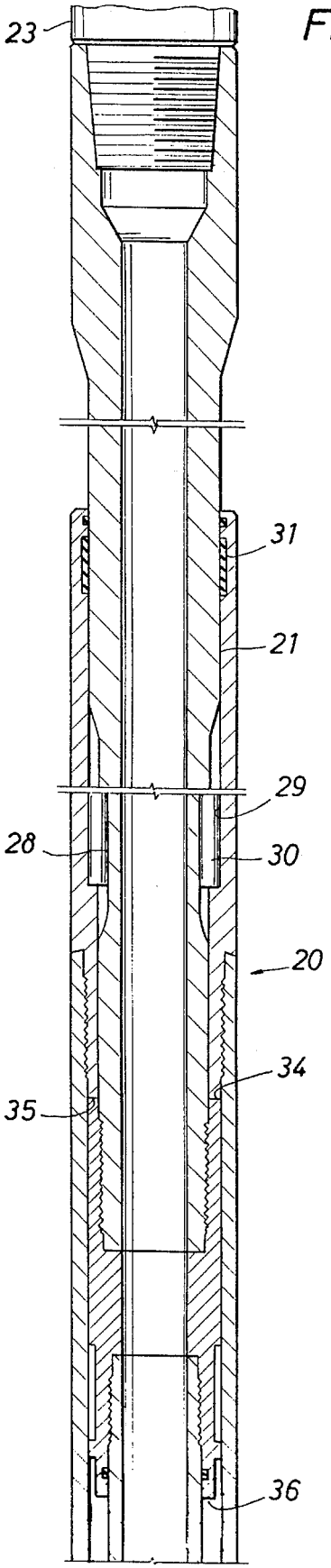
FIGS. 1A, 1B and 1C are vertical sectional views of the upper, intermediate and lower portions of a hydraulic jar, constructed in accordance with the present invention, and with the inner tubular member and the detent ring carried thereby in a raised portion, following an up jar, with respect to the outer tubular member and the restriction therein.

With reference now to the details of the above described drawings, the jar which is indicated in its entirety by reference character 20 comprises telescopically arranged, inner and outer tubular members 21 and 22, respectively. The inner member 21 has a box at its upper end for connection to the lower end of a tubing string 23, and the outer member has a pin 24 at its lower end for connection to the box of a tubular object stuck in the well bore and adapted to be jarred loose by operation of the jar in the manner described to follow. Each of the tubular members is made up of threadedly connected tubular sections, with the lower end of the inner member being slidably reciprocable within packing 25 carried within a lower portion of the outer tubular member and an intermediate portion of the inner tubular member being sealably slidably received within packing 26 carried by an intermediate portion of the outer tubular member. The packings 25 and 26 are of equal diameter so as to define an annular space between the enlarged inner diameter of the outer tubular member intermediate the packings and the outer diameter of the inner tubular member.

Figure 1B:
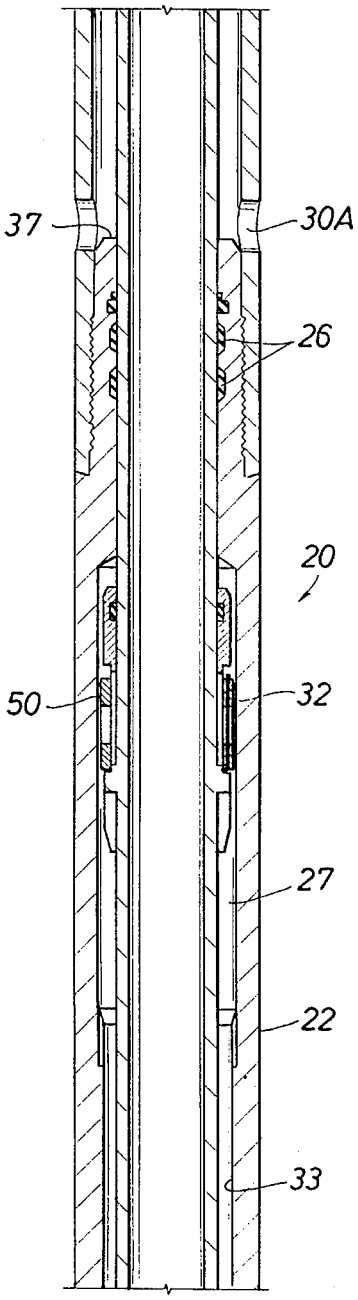
Figure 1C:
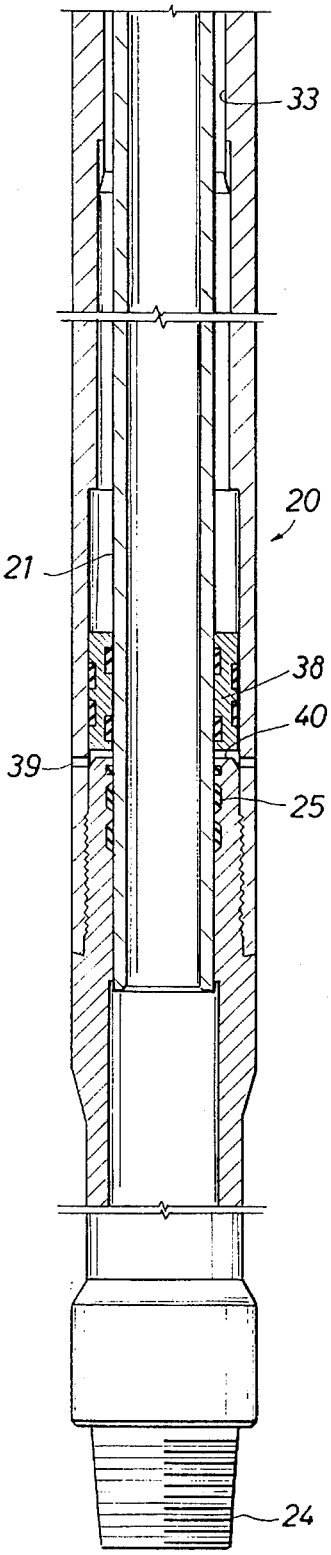

A piston 38 is disposed within the lower end of the annular space and carries packing about its inner and outer diameters for slidably engaging the outer diameter of the inner member and the inner diameter of the outer member above ports 39 formed in the outer member to connect with the annular space above the packing 25, thus equalizing fluid pressure within a detent chamber 27 above the piston with the pressure of well fluid in the annulus about the jar. As well known in the art, the chamber 27 is filled with a suitable hydraulic fluid which is essentially incompressible. As shown in FIG. 1C, the hydrostatic pressure of the well fluid has caused the piston to be raised slightly above an upwardly facing shoulder 40 on the lower end of the outer tubular member which limits downward movement of the piston 38.

The upper portions of the tubular members above the upper packing 26 are provided with oppositely facing grooves 28 and 29 in which pins 30 are received to cause the tubular members to rotate with one another. Packing 31 is carried by the inner diameter of the upper end of the outer tubular member to form a drive chamber in which the splines are protected from debris which might otherwise accumulate therein. Ports 30A formed in the outer tubular member above packing 26 vent this chamber to the annulus of the well bore surrounding the jar so as to prevent a fluid lock as the inner and outer tubular members are vertically reciprocated with respect to one another.

As well known in the art, the tool is adapted to be raised and lowered within the well bore by means of the tubing string 23 from which the upper end of the jar is suspended. The pins 30 permit torque to be applied to the jar in order to make up the pin at its lower end with the object stuck in the hole.

A detent means, indicated in its entirety by reference character 32, is carried about an intermediate portion of the inner tubular member for disposal within the detent chamber 27. The inner diameter of the outer tubular member intermediate the upper and lower ends of the detent chamber has a reduced diameter cylindrical surface providing a restriction 33 through which the detent means 32 is adapted to be moved in order to place the upper tubular member in the tubing string from which it is suspended in compression during a down jar or in tension during an up jar.

When the detent means has been moved upwardly out of the restriction, tension in the tubing string causes an upwardly facing shoulder 34 about the inner tubular member to move rapidly upwardly to engage a downwardly facing shoulder 35 on the outer tubular member to impart an upward jar, and when the detent means has been moved downwardly out of the restriction, compression in the tubing string above the jar causes a downwardly facing shoulder 36 about the inner tubular member to move rapidly downwardly to engage an upwardly facing shoulder 37 on the outer tubular member to impart a downward jar thereto. As previously noted, in the position shown in FIGS. 1A to 1C, the detent means 32 is in an upper portion of the detent chamber above the restriction 33 which it would occupy following an upward jar or preparatory to applying a downward jar. In this position, the jar may be said to be "open".

Figure 2:
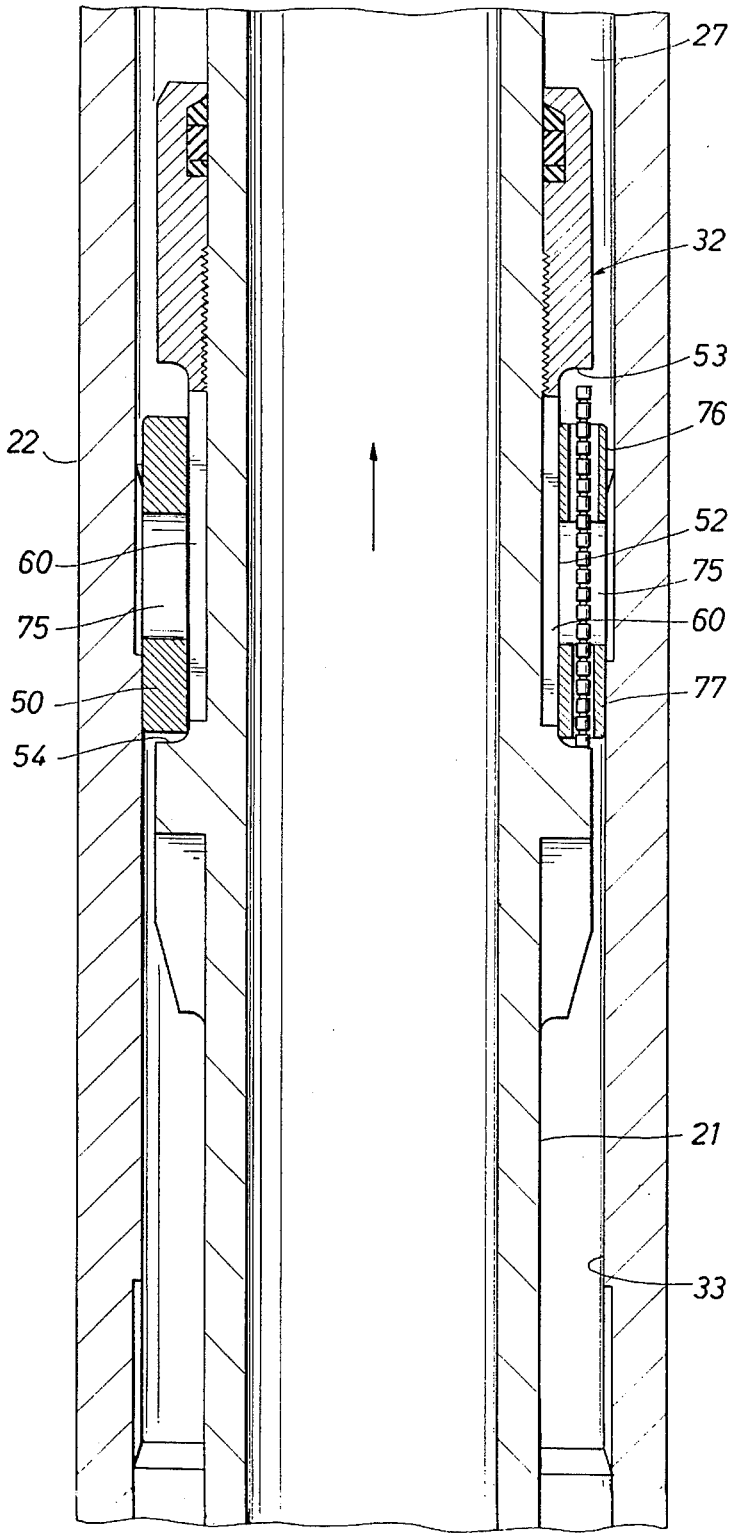
FIG. 2 is an enlarged vertical sectional view of the jar showing the detent ring as it pulled upwardly through the restriction during an up jar.
Figure 3:
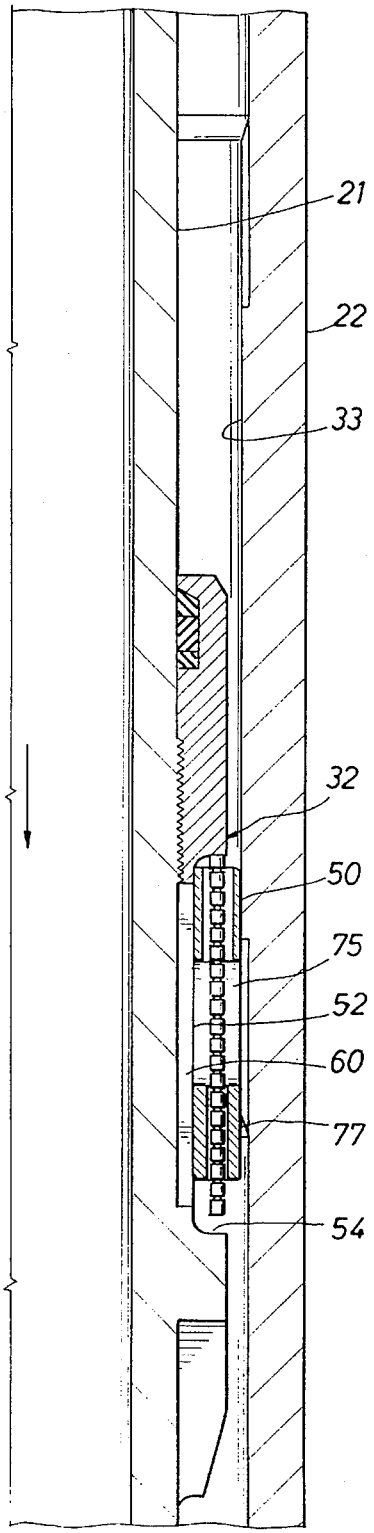
FIG. 3 is a half vertical sectional view similar to FIG. 2, but showing the detent ring as it is moved downwardly through the restriction during a down jar.

As shown in U.S. Pat. No. 5,174,393, the detent means 32 comprises a single detent ring 50 having an outer diameter which is adapted to be fit closely within the restriction 33 and disposed about a reduced diameter portion 52 of the inner tubular member having elongate slots or grooves 60 vertically intermediate upper and lower, downwardly and upwardly facing shoulders 53 and 54, respectively, of the inner tubular member which are spaced apart a distance to permit the detent ring to reciprocate with respect to the inner tubular member. As fully described in the above mentioned patent, slots 60 are formed in the reduced diameter portion of the inner tubular member to connect at their upper ends with the reduced diameter portion when the detent ring is in its lower position (FIG. 2), and to connect at their lower ends with the reduced diameter portion when the detent ring is in its upper position seated on shoulder 53 (FIG. 3).

The detent ring has several lateral holes 75 formed therethrough to connect the inner and outer diameters of the detent ring during all positions of the detent ring in the reduced diameter portion 52 and slots 60 of the inner tubular member. Consequently, in the event the jar is to be moved upwardly, and the inner tubular member raised for this purpose, the detent ring will initially seat upon shoulder 54. As the upper annular portion 76 of the detent ring above the holes 75 moves into the restriction 33, hydraulic fluid will be free to pass into the upper ends of the slots 60 and out the holes 75 even though the lower end of the detent ring is seated upon the shoulder 54, thus disconnecting the lower ends of the slots with the detent chamber. Thus, the detent mechanism moves freely into the restriction until the upper end of the lower annular portion 77 of the detent ring begins to move into the restriction. At this time, the operator is able to detect the beginning of the jarring stroke by observing the weight indicator at the well surface. In the event a full upward jar is to be imposed, the inner tubular member continues to be moved upwardly through the restriction, following which movement of the detent ring out of the restriction permits tension in the inner tubular member to apply an upward jar, as described in accordance with the first embodiment.

Conversely, downward movement of the detent ring through the restriction imparts compression to the inner tubular member which will move the inner tubular member rapidly downwardly in a jarring stroke. If it is then desired to impart another downward jar, the inner tubular member may be moved upwardly to "short cock" the jar. For this purpose, the inner tubular member is raised upwardly to a position where the operator observes a change in the weight indicator indicating that the tool is already in "short cocked" position and therefore requires no further upward movement, but is in detent and ready to fire downward. In any case, during initial upward movement of the inner tubular member for this purpose, the detent ring has moved relatively freely through the restriction due to the passage of hydraulic fluid through the holes 75 and the upper ends of the slots past the upper end of the detent ring which is spaced below the shoulder 53.

As in the case of the aforementioned embodiment of U.S. Pat. No. 5,174,393, the detent means of the present invention also includes a means for metering flow through the detent ring as it is moved upwardly or downwardly through the restriction. Thus, in the prior patent, a metering pin extends vertically through a passageway in a portion of the detent ring circumferentially intermediate the lateral holes connecting its inner and outer diameter to restrict flow through the passageway. More particularly, the metering pin was disposed vertically intermediate the upper and lower shoulders about the inner tubular member.

In accordance with the present invention, however, each such metering pin 80 has upper and lower portions 80A and 80B which extend through upper and lower passageways 81A and 81B, respectively, connecting the lateral opening 75 through the ring with the upper and lower ends thereof, respectively, and thus with the detent chamber above and below the detent means during movement of the detent ring through the restriction. Thus, during an up jar, as illustrated in FIG. 2, flow past the detent ring is confined to that which passes through the annular space between the lower pin portion 80B and the lower passageway 81B. Conversely, during a down jar, as illustrated in FIG. 3, flow is confined to passage through the annular space between the upper pin portion 80A and upper passageway 81A. More particularly, the upper and lower pin portions are formed on the upper and lower end, respectively, of a pin having a constant diameter, and the upper hole 81A is of larger diameter than the lower hole 81B, so that the annular space about the upper pin portion is greater than the annular space about the lower pin portion. Consequently, during an upstroke, as the detent ring is being lifted through the restriction during an up jar, the available flow area is less than that when it is lowered through the restriction during a downward jar where the "delay" in movement through the restriction would normally be greater. Thus, as previously noted, the relative sizes of the pins and passageways may be so designed as to permit essentially the same "delay" during both an up and down jar.

Although, in the illustrated arrangement, a single pin of uniform diameter extends through passageways of different diameters, it will be obvious to those skilled in the art that alternate arrangements for providing the desired flow areas during downward and upward jars may be used, all within the skill of the art, the important thing being that, in any case, the opening 75 through the detent ring connects with the upper end of the ring and with the lower end of the ring below it.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A hydraulic jar for use in applying up and down jars to an object stuck in a well bore, comprising, first and second telescopically arranged, tubular members connectible, respectively, to the stuck object and a pipe string adapted to be raised and lowered within the well bore, and being circumferentially spaced apart and sealed with respect to one another along equal diameter portions to form an annular space therebetween, the outer of the first and second members having a port therein to connect one end of the space with the well bore, a piston ring being sealably slidable within the space to separate the port from a chamber within the space which contains hydraulic fluid, one of the tubular members having a cylindrical restriction within the chamber and the other tubular member having longitudinal grooves formed about its circumference, and longitudinally spaced upper and lower shoulders above and below the rings, and detent ring means carried by the other member within the annular space vertically intermediate the upper and lower shoulders with one side closely surrounding the grooves and having upper and lower annular positions on its outer sides, said detent ring means being vertically reciprocable with respect to said other member between a first position in which its lower end is seated on the lower shoulder of the other member to prevent flow therepast, as a lower annular portion of its other side is pulled upwardly through the restriction, and a second position in which its upper end is seated on the upper shoulder of said other member to prevent flow therepast, as an upper annular portion of its other side is pushed downwardly through the restriction, said detent ring means having metering means which permit limited flow therethrough as said annular portions move through said restriction and means connecting its one side with its other side intermediate said annular portions so that the annular portion last to move out of the restriction is relatively freely movable back into the restriction until the other annular portion enters the restriction, said tubular members having means arranged to engage one another for imparting an up jar to the stuck object as the lower annular portion of the detent ring means is pulled upwardly out of the restriction, and a down jar thereto as the upper annular portion of the detent ring means is pushed downwardly out of the restriction, and said metering means being of such construction as to permit a lesser volume of limited flow therethrough, during an upward jar, then during a downward jar.

2. As in claim 1, wherein said metering means comprises upper and lower holes in the detent ring means extending between the connecting means and the annular spaces above and below the detent ring means, respectively, and means including upper and lower pin portions extending through the upper and lower holes respectively, the annular space between the upper hole and the upper pin portions of being greater than that between the lower hole and lower pin portion.

3. As in claim 2, wherein the upper hole is of larger diameter than the lower hole, and the upper and lower pin portions are of essentially the same diameter.

4. A hydraulic jar of the character defined in claim 1, wherein the detent means comprises a single detent ring having passageway means therein connecting the one side with the outer side thereof intermediate said annular portions, and the pin portions comprise a single pin having its upper end extending through the upper hole and its lower end extending through the lower hole.

5. A hydraulic jar of the character defined in claim 4, wherein the passageway means comprises a hole extending through the detent ring to connect its opposite sides.

6. A hydraulic jar of the character defined in claim 4, wherein the upper hole is of larger diameter than the lower hole, and the pin is of essentially constant diameter.

* * * * *

UNITED STATES PATENT AND TRADEMARK OFFICE

CERTIFICATE OF CORRECTION

PATENT NO. : 5,595,253

DATED : January 21, 1997

INVENTOR(S) : Glenn J. Martin; Chuan C. Teng

It is certified that error appears in the above-indentified patent and that said Letters Patent is hereby corrected as shown below:

n the Abstract: Line 4, change "in" (first occurence) to --is--.

Column 2, line 10, change "and" to --an--.
Column 2, line 37, change "up" to --down--.
Column 3, line 24, change "then" to --than--.
Column 3, line 63, after "it" insert --is--.
Column 4, line 1, change "section" to --sectional--.

n the Claims:
Column 8, line 12, change "then" to --than--.
Column 8, line 21, after "portions" cancel --of--.
Column 8, line 33, change "outer" to --other--.

Signed and Sealed this

Thirteenth Day of May, 1997

Bruce Lehman

*Attest:*

BRUCE LEHMAN

*Attesting Officer*

*Commissioner of Patents and Trademarks*